US008505727B2

(12) United States Patent
Dalton et al.

(10) Patent No.: US 8,505,727 B2
(45) Date of Patent: Aug. 13, 2013

(54) PACKAGE WITH SWITCH AND CONTAINING AN ELECTRICAL DEVICE

(75) Inventors: David R. Dalton, Turramurra (AU); Kin Sang Chung, Kowloon (HK); Michael Squires, Ryde (AU)

(73) Assignee: Eveready Battery Company, Inc., St. Louis, MO (US)

( * ) Notice: Subject to any disclaimer, the term of this patent is extended or adjusted under 35 U.S.C. 154(b) by 1779 days.

(21) Appl. No.: 10/570,419

(22) PCT Filed: Sep. 2, 2004

(86) PCT No.: PCT/AU2004/001186

§ 371 (c)(1),
(2), (4) Date: Mar. 2, 2006

(87) PCT Pub. No.: WO2005/021401

PCT Pub. Date: Mar. 10, 2005

(65) Prior Publication Data

US 2007/0019402 A1 Jan. 25, 2007

(30) Foreign Application Priority Data

Sep. 3, 2003 (AU) ..... 2003904816

(51) Int. Cl.
*B65D 85/28* (2006.01)

(52) U.S. Cl.
USPC ..... 206/461; 206/722; 206/462; 206/806; 362/157

(58) Field of Classification Search
USPC ..... 206/722, 335, 216, 579, 486, 476, 206/461, 462, 488, 806, 371; 362/157
See application file for complete search history.

(56) References Cited

U.S. PATENT DOCUMENTS

| | | | | |
|---|---|---|---|---|
| 2,668,229 | A * | 2/1954 | Akroyd | 362/158 |
| 2,983,368 | A * | 5/1961 | Lugt, Jr. | 206/470 |
| 3,042,796 | A * | 7/1962 | De Forest | 362/158 |
| 3,408,758 | A * | 11/1968 | Doring | 40/124.06 |

(Continued)

FOREIGN PATENT DOCUMENTS

| | | | |
|---|---|---|---|
| WO | 9935627 | A1 | 7/1999 |
| WO | 0055743 | A1 | 9/2000 |

OTHER PUBLICATIONS

Patent Cooperation Treaty (PCT), International Search Report for Application PCT/AU2004/001186 filed Sep. 2, 2004, Mailed Oct. 1, 2004, 5 pgs., Australian Patent Office, Australia.

(Continued)

*Primary Examiner* — Andrew Perreault
(74) *Attorney, Agent, or Firm* — Eveready Battery Company, Inc

(57) ABSTRACT

A blister package (12) of transparent plastics material having an actuation portion (18), an electrical device such as a flashlight (14) with a slider switch (32) disposed at least partially within the package, the device including a battery power source (22) and an activatable component such as a LED or light; and a package switch (46) with actuation element (66) having an activation condition and a deactivation condition and being changeable from its deactivation condition to its activation condition. The package and device combination being configured for the power source to form part of a closed electrical circuit with, and to activate, the activatable component when the package switch is in its activation condition, and for the circuit to be open once the package switch has changed to its deactivation condition. The consumer can test the operation of the packaged flashlight by operating the switch (46) to illuminate either the LED (24) or the fluorescent tube (26).

23 Claims, 3 Drawing Sheets

(56) References Cited

U.S. PATENT DOCUMENTS

| | | | | |
|---|---|---|---|---|
| 3,780,939 | A * | 12/1973 | Woodie | 234/115 |
| 3,908,827 | A * | 9/1975 | Bemmels et al. | 206/478 |
| 4,046,251 | A * | 9/1977 | Bruml | 206/780 |
| 4,171,050 | A * | 10/1979 | Murray et al. | 206/463 |
| 4,354,598 | A * | 10/1982 | Schillinger | 206/462 |
| 4,549,654 | A | 10/1985 | Tiesman | |
| 4,753,350 | A * | 6/1988 | Seymour | 206/476 |
| 4,832,612 | A * | 5/1989 | Grabbe et al. | 439/71 |
| 4,925,025 | A | 5/1990 | Anten et al. | |
| 5,048,677 | A * | 9/1991 | Pedracine | 206/573 |
| 5,392,919 | A * | 2/1995 | Passamoni | 206/576 |
| 5,424,927 | A * | 6/1995 | Schaller et al. | 362/157 |
| 6,311,839 | B1 | 11/2001 | Lo | |
| 6,727,826 | B1 | 4/2004 | Ki Kwan et al. | |
| 6,758,716 | B1 | 7/2004 | Rehkemper et al. | |
| 2002/0106624 | A1 | 8/2002 | Chan | |
| 2004/0055921 | A1 * | 3/2004 | Parsons | 206/472 |
| 2004/0168272 | A1 | 9/2004 | Prineppi | |
| 2004/0217021 | A1 * | 11/2004 | Chao | 206/5 |
| 2005/0177961 | A1 | 8/2005 | Prineppi | |

OTHER PUBLICATIONS

Patent Cooperation Treaty (PCT), Written Opinion of the International Searching Authority for Application PCT/AU/2004/001186 filed Sep. 2, 2004, Mailed Oct. 1, 2004, 3 pgs., Australian Patent Office, Australia.

Patent Cooperation Treaty (PCT), Second Written Opinion of the International Preliminary Examining Authority for Application AU/2004/001186 filed Sep. 2, 2004, Mailed Aug. 10, 2005, 6 pgs., Australian Patent Office, Australia.

* cited by examiner

PACKAGE WITH SWITCH AND CONTAINING AN ELECTRICAL DEVICE

FIELD OF THE INVENTION

This invention relates to a package-and-device combination, where, in a preferred embodiment, the device is a flashlight.

BACKGROUND TO THE INVENTION

Known electrical devices of the type that are powered by batteries are sometimes offered for sale in such a way that a consumer can switch the device on to test its functioning. This is permitted either by displaying the device unpackaged, or displaying it in packaging of a suitable type, such that the "on-off" switch of the device is readily accessible to the consumer.

Disadvantages of this are that the switches of such devices can become worn or damaged due to frequent testing by consumers, and also that consumers may inadvertently fail to switch the devices off with the result that the batteries run flat.

It is an object of the invention, at least in preferred embodiments, to overcome or ameliorate one or more of the disadvantages of the prior art.

SUMMARY OF THE INVENTION

According to the invention there is provided a package-and-device combination including:

a package having an actuation portion;

an electrical device disposed at least partially within the package, the device including a power source and an activatable component; and a package switch having an activation condition and a deactivation condition and being changeable from its deactivation condition to its activation condition by movement of said actuation portion, the combination being configured for the power source to form part of a closed electrical circuit with, and to activate, the activatable component when the package switch is in its activation condition, and for said circuit to be open once the package switch has changed to its deactivation condition.

The electrical device can include a device switch having an activation condition and a deactivation condition, and the combination is configured for the power source to form part of said closed electrical circuit with, and to activate, the activatable component when the device switch and the package switch are in their respective activation conditions, and for said circuit to be open once either the device switch or the package switch has changed to its respective deactivation condition.

The device can be a flashlight, and the activatable component is at least one light source of the flashlight. The flashlight can include two said light sources, each configured to form part of a different said circuit of the flashlight, and the device switch has two distinct activation conditions, one being an activation condition in relation to one of said circuits and the other being an activation condition in relation to the other of said circuits.

The combination can include a contact element configured to form part of the circuit, wherein at least part of the package switch is disposed between at least part of the power source and the contact element The power source can include a plurality of batteries and the contact element is configured to establish an electrical connection between a particular two of said batteries, said part of the package switch being disposed between one of said particular batteries and the contact element. The part of the package switch can be constituted by an interposer element which has a pair of interposer element contacts separated by electrical insulating means, the package switch further including connection means configured to establish electrical connection between said interposer element contacts when the package switch is in its activation condition.

The connection means can include a switch actuation element disposed adjacent said actuation portion of the package, the switch actuation element including a pair of switch contacts, the switch contacts being configured to be moved together, into electrical connection with each other, by effecting said movement of the actuation portion, to establish electrical connection between said interposer element contacts, and to be moved out of electrical connection with each other to break the electrical connection between said interposer element contacts.

The switch actuation element can include a resilient element configured to bias the switch contacts apart from each other. Preferably the resilient element is of a spongy material.

Each of said interposer element contacts can be connected to a respective one of said switch contacts by an electrical wire.

The flashlight can include a housing defining a battery chamber in which the batteries are disposed, the housing defining a battery insertion opening to said chamber; and a battery housing cover for closing the opening, the contact element being disposed on the cover.

The interposer element can be removably mounted on the cover.

At least one of the cover and the interposer element can include location means for locating the interposer element relative to the cover.

The location means can include complementary location formations on the cover and interposer element.

The location means can be configured to releasably lock the interposer element onto the cover.

The interposer element can be mounted to the cover by mounting means which include a frangible connection.

The actuation portion of package can include a recessed formed in said package. The recess can be used to house and locate said package switch on said package. The actuation portion can include a depression formed in the package material. The depression can aid in the actuation of the switch and or to locate a user's finger or thumb over the switch contacts.

BRIEF DESCRIPTION OF THE DRAWINGS

Embodiments of the invention will now be described, by way of example only, with reference to the accompanying drawings in which.

DETAILED DESCRIPTION

Figure 1:
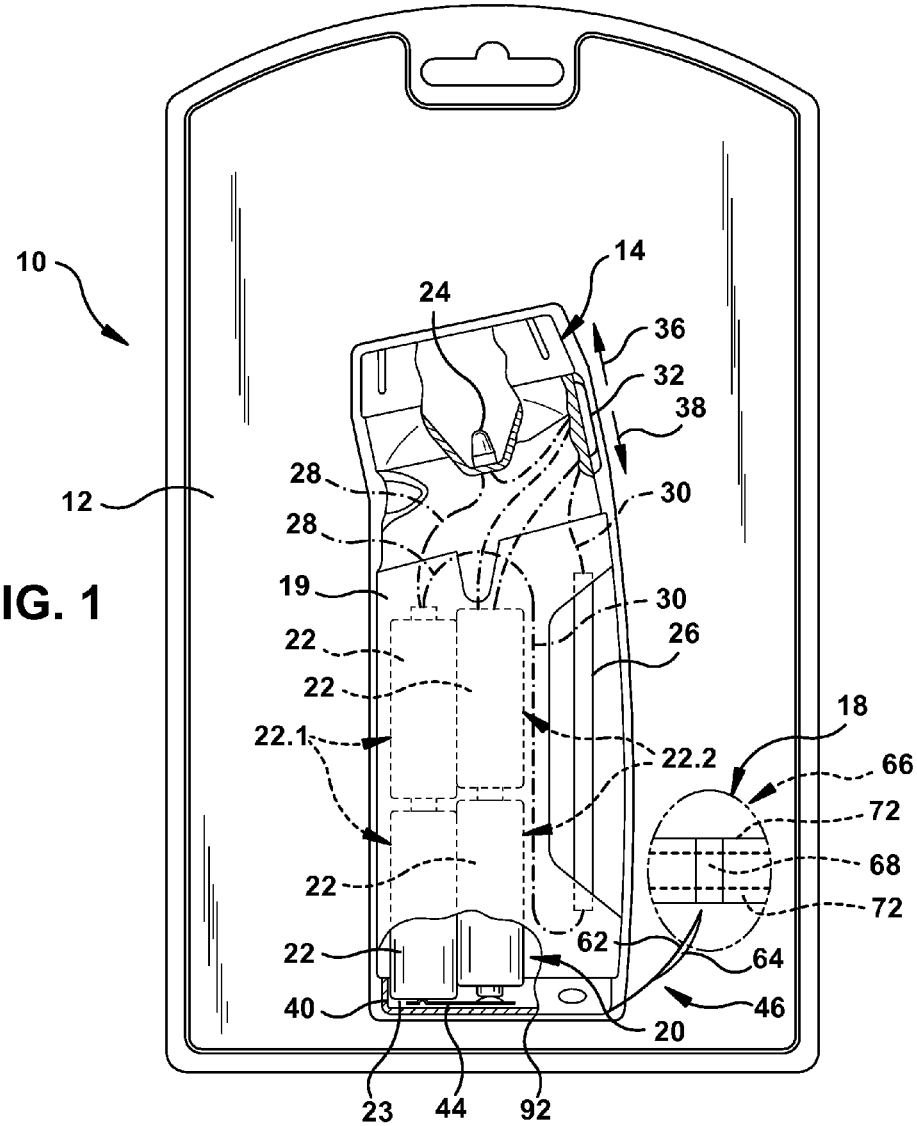
FIG. 1 is a front elevation of a package-and-device combination.
Figure 2:
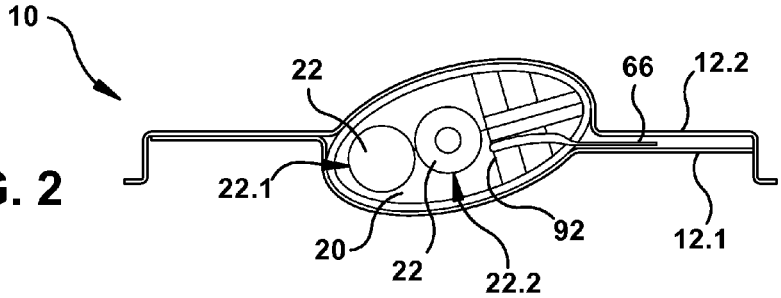
FIG. 2 is a bottom view of the combination of FIG. 1.

Referring to FIGS. 1 and 2, there is shown a package-and-device combination 10 which includes a package 12 and a device in the form of a flashlight 14 disposed within the package.

Figure 3:
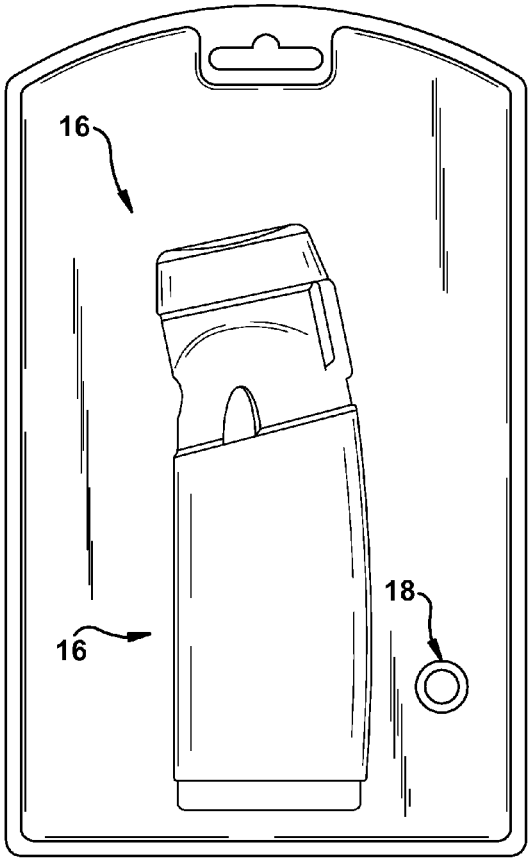
FIG. 3 is a front elevation of the package of FIG. 1.
Figure 4:
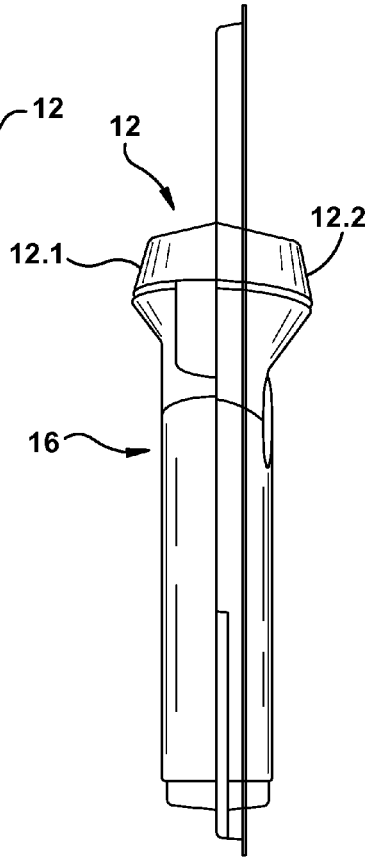
FIG. 4 is a side elevation of the package of FIG. 3.

Referring to FIGS. 3 and 4, the package 12 is of transparent plastics material and has a central region 16 which is outwardly contoured so as to define an interior space substantially complementary to the outer shape of the flashlight 14. Accordingly, the package 12 constitutes a "blister" package.

The package 12 consists of two portions 12.1 and 12.2 (see FIG. 4), which are superposed on, and engaged with, each other, to define the space in which the flashlight 14 is accommodated.

The package 12 has a zone which constitutes an actuation portion 18 of the package 12 (see FIG. 1), which is described further below.

With reference primarily to FIG. 1, the basic configuration of the flashlight 14 itself will now be described, although, as set out below, there are components of the combination 10 which interact with the flashlight to affect its configuration. The flashlight includes a housing 19 which defines a central chamber 20, in which are accommodated batteries 22, arranged in two pairs 22.1 and 22.2, the batteries 22 of each pair 22.1 and 22.2 being in series with each other. The chamber 20 has an opening 23 at the lower end of the housing 19 as shown in FIG. 1, for insertion of the batteries 22 into the chamber. The flashlight 14 is also provided with two light sources, a first being in the form of a white light emitting diode (LED) 24, and the second being in the form of a fluorescent tube 26.

The flashlight 14 has two electric circuits 28 and 30, shown schematically in dashed lines in FIG. 1.

A slider switch 32 is provided, and is connected to each of the circuits 28 and 30 so as to be capable of opening or closing that portion of the respective circuit 28 or 30, at which the switch 32 is disposed.

The slider switch 32 is configured to have a central "off" condition as illustrated in FIG. 1, and to be slidable relative to the housing 19 in a first direction 36 for activating the LED 24, or in an opposite, second direction 38, for activating the fluorescent tube 26. It will thus be appreciated that sliding the switch 32 in the first direction 36 closes that portion of the electric circuit 28 at which the switch 32 is disposed, and sliding the switch 32 in the second direction 38 closes that portion of the circuit 30 at which the switch 32 is disposed.

The flashlight 14 also includes a battery housing cover 40 for closing the opening 23 into the chamber 20. (The flashlight 14 is shown with the battery housing cover 40 removed in FIG. 2, and the battery housing cover 40 is shown in more detail in FIG. 6).

The battery housing cover 40 has, mounted thereon, a contact element 44 which electrically interconnects the adjacent batteries 22 of the two pairs of batteries 22.1. and 22.2, such that these pairs 22.1 and 22.2 of batteries are connected in series with each other.

It will be appreciated that the batteries 22, slider switch 32, and contact element 44 all constitute common components of the two circuits 28 and 30.

Figure 5:
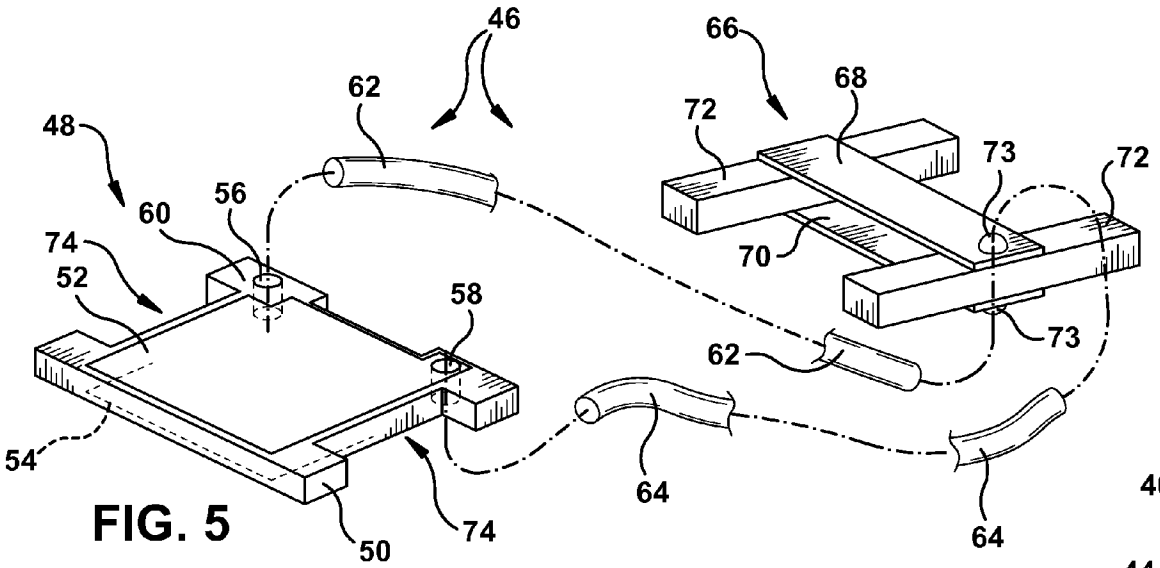
FIG. 5 is a partial schematic perspective view of components of the combination of FIG. 1.

The combination 10 also includes a package switch, generally designated 46 (see particularly FIG. 5). The package switch 46 includes an interposer element 48 which, in turn, includes a central sheet 50 of electrically insulating material, and a pair of electrical contacts 52 and 54, one on each side of the central sheet 50. A pair of holes 56 and 58 extend through the central sheet 50. One of the holes 56 opens through the contact 54, while the contact 52 has a cut-out 60 positioned such that the hole 56 is effectively spaced apart from the contact 52. Similarly, the hole 58 opens through the contact 52 while the contact 54 is provided with a cut-out (not shown) similar to the cut-out 60, and which results in the hole 58 being effectively spaced apart from the contact 54.

A pair of electric wires 62 and 64 have ends which extend through the holes 56 and 58, respectively. The wire 62 is soldered to the contact 54 to establish an electrical connection therewith, and the wire 64 is soldered to the contact 52 to establish electrical connection therewith. As a result of the cut-out 60 in the contact 52, and the corresponding cut out in the contact 54, the wire 62 is not in electrical connection with the contact 52 while the wire 64 is not in electrical connection with the contact 54. The passing of the wires 62 and 64 through the holes 56 and 58, respectively, assists in strengthening the connection between the wires 62 and 64 and the respective contacts 54 and 52.

The package switch 46 also includes a switch actuation element 66 which includes a pair of switch contacts 68 and 70 which are kept spaced apart by a pair of resilient elements 72. The resilient elements 72 are of a suitable spongy material, such as a soft elastomeric material, or a felt-like material which can be in the form of double-sided tape. The double sided tape will allow the switch 46 to be secured to package elements for assembly as well as to secure the respective ends of contacts 68 and 70 in a spaced apart condition, aligned one over the other.

The resilience and sponginess of the resilient elements 72 allows the switch contacts 68 and 70 to be forced together so as to make contact with each other and keeps the contacts 68 and 70 apart when the required actuation force is not present.

The electric wire 62 is connected to the switch contact 70, and the electric wire 64 is connected to the switch contact 68, this connection between the respective wires 62 and 64 and switch contacts 70 and 68, being an electrically conductive connection established by solder 73.

The central sheet 50 of the interposer element 48 is provided with a pair of side recesses 74, and is engageable with the battery housing cover 40, as described in more detail below.

Figure 6:
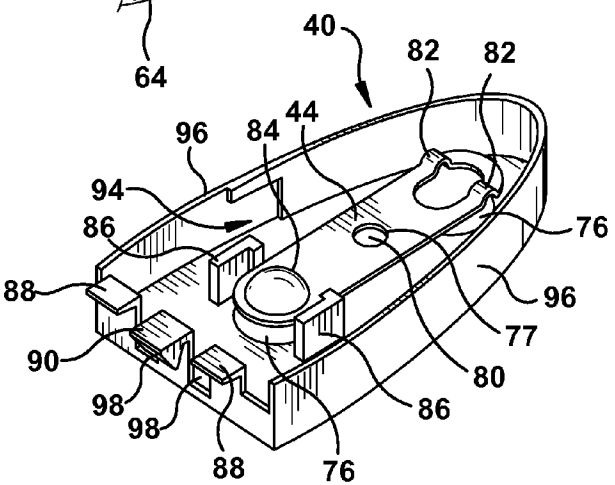
FIG. 6 is a schematic perspective view of a component of the device of FIG. 1.

Referring to FIG. 6, the battery housing cover 40, which is of plastics material, is shown in more detail. The contact element 44 is mounted to the battery housing cover 40 on a pair of spacer studs 76. The contact element 44 is provided with a central aperture 77 through which a plastic, rivet-like formation 80, which is an integral part of the battery housing cover 40, extends, so as to fix the contact element 44 to the battery housing cover 40.

The contact element 44, at one end, is provided with a pair of ridges 82, and at the opposite end is provided with a dome-shaped formation 84. The ridges 82 are configured to facilitate electrical contact with the adjacent battery 22 of the battery pair 22.1, and the dome-shaped formation 84 is configured to facilitate electrical connection with the adjacent battery 22 of the battery pair 22.2.

The battery housing cover 40 is provided with a pair of columns 86 which are configured to fit within the side recesses 74 of the interposer element 48, as described in more detail below. The battery housing cover 40 is also provided with a pair of location lugs 88 and a central engagement lug 90. The battery housing cover 40 is engageable with the housing 19 of the flashlight 14 by sliding the cover 40 into place over the opening 23, such that the location lugs 88 and the engagement lug 90 slide over an adjacent rim 92 forming part of the housing 19. The engagement lug 90 is configured to releasably snap-engage with the rim 92 to hold the battery housing cover 40 in place, while the location lugs 88 are configured to slide over the rim 92 to further reinforce the battery housing cover 40 against being inadvertently pulled off the housing 19.

The battery housing cover 40 is also provided with slots 94 in side walls 96 of the battery housing cover 40 (only one of the slots 94 being shown), to engage with complementary formations (not shown) on the housing 19, to further reinforce the engagement between the battery housing cover 40 and the housing 19.

Between each respective location lug 88 and the central engagement lug 90, there is defined a slot 98.

In the configuration of the package-and-device combination 10 shown in FIG. 1, the interposer element 48 is engaged with the battery housing cover 40 such that the contact 54 is in abutment with the dome-shaped formation 84 of the contact element 44, with the columns 86 being accommodated in the side recesses 74 of the central sheet 50. The electrical wires 62 and 64 extend through the slots 98, and the switch actuation element 66 is disposed between the package portions 12.1 and 12.2 of the package 12, in the actuation portion 18 of the package 12, as shown in FIG. 1.

As a result of the electrically insulating central sheet 50, and the resilient elements 72 which keep the switch contacts 68 and 70 apart from each other, it will be appreciated that the contacts 52 and 54 of the interposed element 48 are electrically disconnected and therefore insulated from each other. Thus, with the battery housing cover 40 engaged with the housing 19 as shown in FIG. 1, it will be understood that the interposer element 48 is interposed between the battery 22 of the battery pair 22.2 and the contact element 44. Accordingly, in this configuration, the interposer element 48 serves to ensure that the respective electric circuits 28 and 30 are in an open (non-conducting) condition.

However, the opening of the circuits 28 and 30 by the interposer element 48 is nullified when the switch contacts 68 and 70 are brought into contact with each other, thus establishing electrical connection between them, and thus also establishing electrical connection between the contacts 52 and 54 via the electric wires 64 and 62.

The package-and-device combination 10 provides a useful means of displaying the packaged flashlight 14, for example when it is offered for sale. Thus, a consumer can test the operation of the flashlight by forcing the switch contacts 68 and 70 into electrical connection with each other, against the biasing force of the resilient elements 72, to illuminate either the LED 24 or the fluorescent tube 26. To achieve this, when the flashlight 14 is inserted into the package 12 during packaging, an election can be made as to which of the LED 24 or fluorescent tube 26 is to be illuminated when the flashlight 14 is tested by the consumer. This is done by moving the slider switch 32 in the first direction 36 (for illuminating the LED 24) or in the second direction (to illuminate the fluorescent tube 26).

With the slider switch 32 having been moved in the desired direction 36 or 38, the flashlight 14 is packaged in the package 12 with the interposer element 48 serving to keep the relevant electric circuit 28 or 30 in the open condition, despite the slider switch being in a position which closes that part of the respective circuit 28 or 30 at which the slider switch 32 is disposed. Consequently, although the relevant light source 24 or 26 is not illuminated once the flashlight 14 has been packaged, the package switch 46 allows a consumer to close the relevant circuit 28 or 30, by forcing the switch contacts 68 and 70 together, which, in turn, is achieved by the consumer pressing together the portions 12.1 and 12.2 of the package 12 at the actuation portion 18 of the package 12.

Once the flashlight 14 has been purchased, the battery housing cover 40 can be removed from the housing 19, the interposer element 46 can be removed from the battery housing cover 40, and the battery housing cover 40 can then be replaced on the housing 19. Thus, the package switch 46 is effectively removed from the flashlight 14, allowing the flashlight 14 to be operated merely by movement of the slider switch 32.

It will be appreciated that, to enable the contact element 44 to make proper contact with the relevant battery 22 when the interposer element 48 is removed, the columns 86 must be of sufficiently short length such that they do not prevent that battery 22 engaging the contact element 44.

In an alternative embodiment (not shown), the columns 86 can be configured to releasably lock onto the interposer element 48. In this case, the columns 86 can be provided with formations for snap-engaging with the interposer element 46. This positive locking of the interposer element 48 with the battery housing cover 40 can facilitate engagement of the battery housing cover 40 with the housing 19 prior to packaging of the flashlight 14 in the package 12. To provide for these snap-engageable formations on the columns 86, the columns 86 can be required to be of greater length than that shown in FIG. 6. This can result in the columns 86 being of such length that, when the interposer element 48 is removed from the flashlight 14, the columns 86 prevent the relevant battery 22 from making the required contact with the contact element 44. To avoid this problem, the columns 86 can be of a frangible nature so that they can be broken off the battery housing cover 40 once the flashlight 14 has been purchased and the interposer element 48 removed. It will be understood that other types of frangible connections between the interposer element 48 and the battery housing cover 40 can be provided in alternative embodiments.

The package 12 can be provided with appropriate inserts of paper or cardboard which conceal the switch contacts 68 and 70 and resilient elements 72, and which have thereon suitable indicia (such as diagrams or words) for inviting a consumer to press the package 12 at the actuation portion 18 to test the functioning of the flashlight 14.

Figure 7:
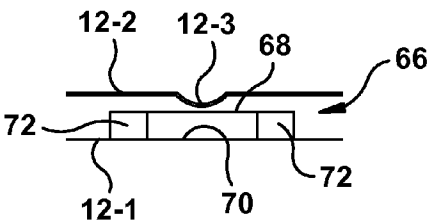
FIG. 7 is a schematic cross section through a package similar to that of FIG. 1.

Illustrated in FIG. 7 is another portion of a modified package which has a switch 66 located between packet portions 12.1 and 12.2. The packet portion 12.1 includes a depression or concave region 12.3 which overlies the contact element 68. The depression 12.3 helps to ensure that there is a minimum gap between the packet portion 12.1 and contact element 68, as well as assuring that the user correctly positions their finger or thumb over the contact element 68.

Figure 8:
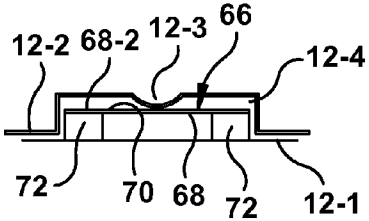
FIG. 8 is a schematic cross section through a package similar to that of FIG. 7.

Illustrated in FIG. 8 is a portion of package similar to that of FIG. 7, except that the depression 12.3 is formed in the ceiling or upper wall of a walled recess 12.4, which is dimensioned to receive the switch 66 and or a cord element 68.2 attached to the top of switch 66. The recess 12.4, by enveloping the switch 66 and cord element 68.2 helps to focus the user's attention to the ability to activate the switch 66.

It will be appreciated that the devices described above allow the consumer to test the functioning of the flashlight 14 without having to use the slider switch 32 of the flashlight 14 itself. This assists in maintaining the switch in good and substantially unused condition, prior to sale of the flashlight 14. In addition, the biasing force exerted by the resilient elements 72 ensures that the electrical connection between the contacts 68 and 70, and hence activation of the flashlight 14 during testing by the consumer, is momentary, until release of the actuation portion 18 by the consumer. Accordingly, this assists in allowing the flashlight 14 to be displayed for sale with the batteries 22 already contained therein, while maintaining the life of the batteries.

If desired, the interposer element 48 can consist of two portions, each having a contact similar to the contacts 52 and 54, which is mounted on an sheet of electrically insulating material, corresponding to, but thinner than, the central sheet 50. Such an interposer element portion can be configured to constitute, essentially, a half of the interposer element 48. Thus, mounting one of the portions on the other portion with the insulating sheets face-to-face results in an element substantially corresponding to the interposer element 48 described above. In this case, the package switch 46 can be comprised of two sections, each section being made up of an interposer element portion as described, together with a wire similar to the wires 62 and 64, a switch contact similar to the switch contacts 68 and 70, and a resilient element similar to the resilient elements 72. These sections can therefore be substantially identical to each other, and be connected to each other to make up a package switch substantially corresponding to the package switch 46. The substantially identical nature of the two sections can assist in facilitating production of this embodiment of the package switch.

It will be understood that the invention disclosed and defined herein extends to all alternative combinations of two or more of the individual features mentioned or evident from the text. All of these different combinations constitute various alternative aspects of the invention.

The foregoing describes embodiments of the present invention, and modifications, including those which are obvious to those skilled in the art, can be made thereto without departing from the scope of the present invention. For example, the device in the package 12 can be other than a flashlight In this case, the device can be of a type that is constantly in operation, rather than a type which is only switched on when it is actually being used (such as a flashlight). In this case, the device might not be provided with a device switch (such as the slider switch 32 of the flashlight 14). Then, it will be appreciated that, when the device is in its package, only the interposer element opens the circuit with the power source so that the device is generally not active, while the package switch allows a consumer to momentarily test the operation of the device. However, once the device has been purchased and the interposer element removed, the circuit will be in an always-closed condition so that the device remains constantly in operation.

The invention claimed is:

1. A package-and-device combination including:

a package having an actuation portion;

an electrical device disposed at least partially within the package, the device including a power source connected to an activatable component; and a package switch having an activation condition and a deactivation condition;

an interposer element connected to the power source, the interposer element being controlled by the package switch;

an electrical circuit comprising the package switch, the interposer element, and the activatable component;

said electrical circuit being open by the interposer element once the package switch has changed to its deactivation condition; and said electrical circuit being closed by the interposer element once the package switch has changed to its activation condition.

2. A combination as claimed in claim 1 wherein the interposer element includes an insulating body having a pair of opposite faces with electrical contact pads to each of which one side of the package switch is connected, each of the contact pads being adapted to form an electrical contact with the electrical circuit.

3. A combination as claimed in claim 1 wherein the electrical device includes a device switch having an activation condition and a deactivation condition, and wherein the combination is configured for the power source to form part of said electrical circuit with, and to activate, the activatable component when the device switch and the package switch are in their respective activation conditions, and for said circuit to be open once either the device switch or the package switch has changed to its respective deactivation condition.

4. A combination as claimed in claim 3 wherein the device is a flashlight, and the activatable component is at least one light source of the flashlight.

5. A combination as claimed in claim 4 wherein the flashlight includes two said light sources, each configured to form part of a different said circuit of the flashlight, and wherein the device switch has two distinct activation conditions, one being an activation condition in relation to one of said circuits and the other being an activation condition in relation to the other of said circuits.

6. A combination as claimed in claim 5 including a contact element configured to form part of the circuit, wherein at least part of the package switch is disposed between at least part of the power source and the contact element.

7. A combination as claimed in claim 6 wherein the power source includes a plurality of batteries and the contact element is configured to establish an electrical connection between a particular two of said batteries, said part of the package switch being disposed between one of said particular batteries and the contact element.

8. A combination as claimed in claim 1 wherein the interposer element is removable to enable the activatable component to be operated without the packet switch.

9. A combination as claimed in claim 8 wherein said package switch includes a pair of switch contacts spaced apart by a resilient element, wherein the resilient element allows the switch contacts to be moved together, into electrical connection with each other and change the package switch to the activation condition in response to a required actuation force, and to keep apart the switch contacts and to break the electrical connection between the switch contacts and change into the deactivation condition when the required actuation force is not present.

10. A combination as claimed in claim 9 wherein the resilient element is of a felt material.

11. A combination as claimed in claim 9 wherein the resilient element is of a spongy material.

12. A combination as claimed in claim 9 wherein the interposer element includes a pair of interposer contacts connected to said switch contacts.

13. A combination as claimed in claim 7 wherein the electric device is a flashlight which includes a housing defining a battery chamber in which the batteries are disposed, the housing defining a battery insertion opening to said chamber; and a battery housing cover for closing the opening, the contact element being disposed on the cover.

14. A combination as claimed in claim 13 wherein the interposer element is removably mounted on the cover.

15. A combination as claimed in claim 14 wherein at least one of the cover and the interposer element includes location means for locating the interposer element relative to the cover.

16. A combination as claimed in claim 15 wherein the location means includes complementary location formations on the cover and interposer element.

17. A combination as claimed in claim 15 wherein the location means are configured to releasably lock the interposer element onto the cover.

18. A combination as claimed in claim 14 wherein the interposer element is mounted to the cover by mounting means which include a frangible connection.

19. A combination as claimed in claim 1 wherein said actuation portion of package includes a recess formed in said package.

20. A combination as claimed in claim 19 wherein said recess is used to house and locate said package switch on said package.

21. A combination as claimed in claim 1 wherein said actuation portion includes a depression formed in said package.

22. A combination as claimed in claim 21, wherein said depression aids in the actuation of the switch and or locates a user's finger or thumb over the switch contacts.

23. A combination as claimed in claim 1 including a device switch forming part of the device and connected to activate or deactivate the device, the device switch being switched to the activated state and in series with the package switch while the interposer element is in place.

* * * * *